US006068365A

United States Patent [19]

Nagoshi et al.

[11] Patent Number: 6,068,365

[45] Date of Patent: May 30, 2000

[54] COLOR INK JET RECORDING APPARATUS WITH RECORDING HEAD ARRANGED AT SHIFTED POSITION

[75] Inventors: Shigeyasu Nagoshi, Kawasaki; Hiromitsu Hirabayashi; Yuji Akiyama, both of Yokohama; Hitoshi Sugimoto, Kawasaki; Miyuki Matsubara, Tokyo, all of Japan

[73] Assignee: Canon Kabushiki Kaisha, Tokyo, Japan

[21] Appl. No.: 07/962,113

[22] Filed: Oct. 16, 1992

[30] Foreign Application Priority Data

Oct. 21, 1991 [JP] Japan ..... 3-272702

[51] Int. Cl.[7] ..... B41J 2/21; B41J 2/145; B41J 2/15

[52] U.S. Cl. ..... 347/43; 347/40

[58] Field of Search ..... 346/1.1, 46, 140 R; 347/40, 43, 41; B41J 2/21

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,571,599 | 2/1986 | Rezanka | 347/43 |
| 4,631,548 | 12/1986 | Milbrandt | 347/43 |
| 4,723,129 | 2/1988 | Endo et al. . | |
| 4,740,796 | 4/1988 | Endo et al. . | |
| 4,855,752 | 8/1989 | Bergstedt | 346/1.1 |
| 4,864,328 | 9/1989 | Fischbeck | 347/43 |
| 4,875,059 | 10/1989 | Masuda | 347/94 X |
| 4,952,942 | 8/1990 | Kanome et al. . | |
| 4,967,203 | 10/1990 | Doan et al. . | |
| 4,999,646 | 3/1991 | Trask | 346/1.1 |
| 5,049,898 | 9/1991 | Arthur et al. | 347/19 |

FOREIGN PATENT DOCUMENTS

| | | | |
|---|---|---|---|
| 59-123670 | 7/1984 | Japan . | |
| 59-138461 | 8/1984 | Japan . | |
| 1-40344 | 2/1989 | Japan | 347/40 |
| 1063185 | 3/1989 | Japan . | |
| 1208143 | 8/1989 | Japan . | |
| 2-6141 | 1/1990 | Japan | B41J 2/21 |
| 2233260 | 9/1990 | Japan . | |
| WO9108902 | 6/1991 | WIPO | B41J 2/21 |

*Primary Examiner*—N. Le
*Assistant Examiner*—Thinh Nguyen
*Attorney, Agent, or Firm*—Fitzpatrick, Cella, Harper & Scinto

[57] ABSTRACT

The mounting positions of a plurality of recording heads (1Y, 1M, 1C, 1K) are set to be variable with respect to a paper feed direction, so that a post-ejection recording head (1Y) is mounted at the downstream side in the paper feed direction as compared to a pre-ejection recording head, thereby preventing generation of banding in color ink jet recording, and improving image quality.

31 Claims, 11 Drawing Sheets

| | Y | M | C | K |
|---|---|---|---|---|
| VERTICAL DEVIATION [μm] Dn | +40 | +20 | 0 | −20 |

FIG. 3

A

A'

| VERTICAL DEVIATION OF POST DEPOSITED INK [ μm ] | | -100 | -90 | -80 | -70 | -60 | -50 | -40 | -30 | -20 | -10 | 0 | +10 | +20 | +30 | +40 | +50 | +60 | +70 | +80 | +90 | +100 |
|---|---|---|---|---|---|---|---|---|---|---|---|---|---|---|---|---|---|---|---|---|---|---|
| 1PASS | BANDING | × | × | × | × | × | × | × | × | △ | △ | △ | △ | △ | ○ | ○ | ○ | ○ | ○ | ○ | ○ | ○ |
| | STRAIGHT LINE | × | × | × | △ | △ | ○ | ○ | ○ | ○ | ○ | ○ | ○ | ○ | ○ | ○ | ○ | △ | △ | × | × | × |
| 2PASS | BANDING | × | × | × | × | × | × | × | △ | △ | △ | △ | △ | ○ | ○ | ○ | ○ | ○ | ○ | ○ | ○ | ○ |
| | STRAIGHT LINE | × | × | × | × | × | × | ○ | ○ | ○ | ○ | ○ | ○ | ○ | ○ | ○ | △ | △ | × | × | × | × |
| 2PASS 1/2 LINE SPACE | BANDING | × | × | × | × | × | × | △ | △ | △ | △ | ○ | ○ | ○ | ○ | ○ | ○ | ○ | ○ | ○ | ○ | ○ |
| | STRAIGHT LINE | × | × | × | △ | △ | ○ | ○ | ○ | ○ | ○ | ○ | ○ | ○ | ○ | ○ | ○ | △ | △ | × | × | × |

B

FIG. 5
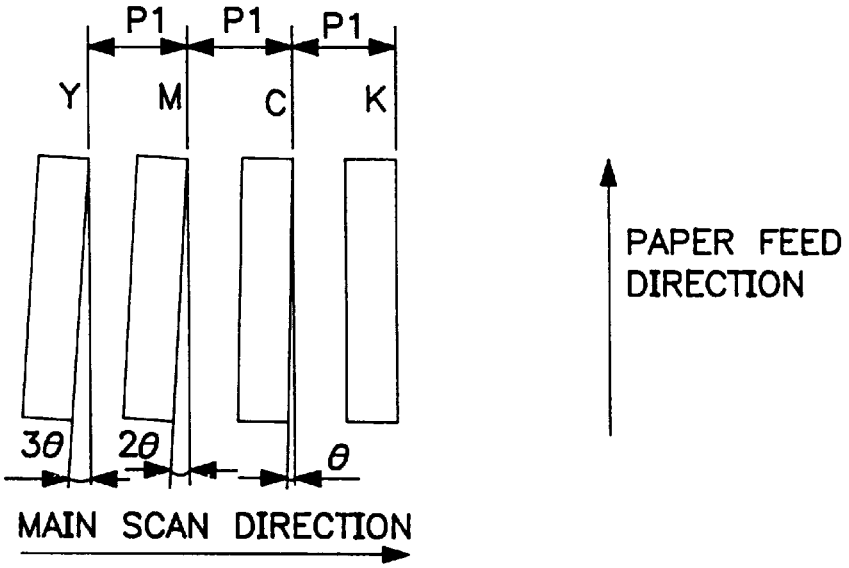
FIG. 6A
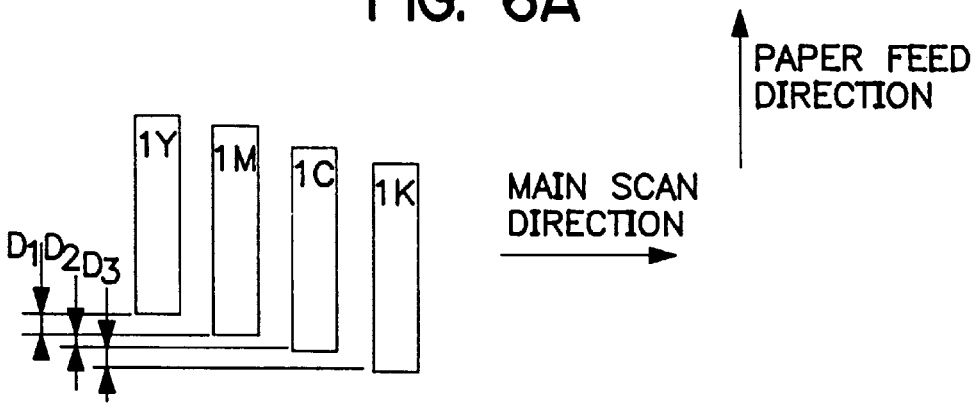
FIG. 6B
| | Y | M | C | K |
|---|---|---|---|---|
| VERTICAL DEVIATION [μm] Dn | +40 | +20 | 0 | −20 |

COLOR INK JET RECORDING APPARATUS WITH RECORDING HEAD ARRANGED AT SHIFTED POSITION

BACKGROUND OF THE INVENTION

1. Field of the Invention

The present invention relates to a color ink jet recording apparatus for performing recording by ejecting a plurality of colors of inks from a recording head having a plurality of ejection orifices.

2. Related Background Art

A case will be examined in detail below wherein a mixed-color dot is formed by landing ink droplets of different colors. When the ink absorbing characteristics of a recording medium are improper in the vertical and horizontal directions, a post deposited ink is absorbed under a pre-deposited ink, and the landing diameter is increased on the surface of the recording medium. FIGS. 14A and 14B show a state wherein a post deposited Y ink spreads outwardly from a pre-deposited C ink. FIG. 14A shows a dot array observed from the recording surface of a recording medium, and FIG. 14B is a sectional view of one dot. When the state of such a solid G portion is enlarged to a visible level, a G portion (hatched portion) obtained by mixing C and Y colors is present inside the dots, and a Y portion (not pure Y, but Y slightly mixed with C, i.e., yellow-rich green; to be referred to as G(Y) hereinafter) spreads to surround the G portion, as shown in FIG. 15. In this case, since a serial printer is used, a carriage performs a line feed operation according to the recording width after the recording operation of each line, and then continues the recording operation of the next line. If a solid G portion having an area over several lines is recorded, each line corresponds to the solid G portion shown in FIG. 15. More specifically, a G(Y) portion spreads from the peripheral portion of the recorded portion of each line, and a connection section between two adjacent lines is connected by G(Y) portions. For this reason, although the inner portion of each line is recorded in G, a G(Y) portion becomes linearly conspicuous in the horizontal direction in the connection section between the adjacent lines. Thus, a whitish horizontal stripe is formed. This phenomenon is called "banding", and considerably deteriorates the image quality of a solid mixed-color portion.

As a recording mode for preventing this phenomenon, a thinning multi-pass recording method for recording thinned patterns of a connection section in a plurality of number of times of recording scan operations (described in, e.g., U.S. Pat. No. 4,967,203) is known. In the case of a 2-pass recording mode as an example of the multi-pass recording mode, some dots, e.g., dots thinned out in a checker pattern are recorded in the first-pass carriage scan operation, and a line feed operation is performed by a line space ½ a normal space. Thereafter, dots thinned out in a reverse checker pattern for compensating for the former dot pattern are recorded in the second-pass carriage scan operation (to be referred to as a thinning multi-pass ½ line-space method hereinafter). According to the thinning multi-pass ½ line-space method, a stripe pattern in a connection section is not so conspicuous as compared to a normal 1-pass recording method.

However, this method is insufficient, and a white or black stripe pattern may often be formed in a connection section between adjacent lines, thus posing a serious problem upon formation of an image in a serial color ink jet recording apparatus.

SUMMARY OF THE INVENTION

It is, therefore, an object of the present invention to provide a color ink jet recording apparatus and method, which can improve image quality.

It is another object of the present invention to provide a color ink jet recording apparatus and method, which can prevent banding in color recording.

In order to achieve the above objects, according to the present invention, a color ink jet recording apparatus comprises a plurality of recording heads, each having a plurality of ejection orifices aligned at a predetermined pitch, for forming a swath by ejecting different color inks from the plurality of ejection orifices, and image forming means for scanning the plurality of recording heads relative to a recording medium, and conveying the recording medium so as to sequentially form a color image by mixing the color inks. The ink ejected from a post-ejection recording head of the plurality of recording heads is infiltrated and fixed while being shifted by not more than the predetermined pitch toward the downstream side in a convey direction of the recording medium as compared to the ink ejected from a pre-ejection recording head.

Furthermore, in order to achieve the above objects, according to the present invention, a color ink jet recording method for forming an image on a recording medium by scanning a plurality of recording heads, each having a plurality of ejection orifices aligned at a predetermined pitch, for ejecting different color inks from the plurality of ejection orifices, comprises the steps of: forming a first swath by ejecting a first color ink onto the recording medium; and forming a second swath by ejecting a second color ink onto the first swath previously formed on the recording medium, the second swath being shifted from the first swath by not more than the predetermined pitch toward a downstream side in a convey direction of the recording medium.

More specifically, in order to set the recording width of a post-ejection head to be smaller than that of a pre-ejection head, the shift means can change average ejection amounts set in units of recording heads, and sets a smaller ejection amount of the post-ejection head than that of the pre-ejection head, or can change the ejection amount distributions in units of recording heads, and sets a smaller ejection amount of the upstream-side end portions in a recording medium convey direction of the post-ejection head than that of the pre-ejection head, or can change the mounting angle of each recording head with respect to the recording medium convey direction, and sets a larger inclination angle of the post-ejection head than that of the pre-ejection head, or can change the ejection orifice pitch of each recording head, and sets a smaller ejection orifice pitch of the post-ejection head than that of the pre-ejection head.

Alternatively, in order to adjust the ink landing position in units of heads so that the ink landing position on the recording medium by the post-ejection head is set at the downstream side in the recording medium convey direction, the shift means can change the mounting position of each recording head in the recording medium convey direction, and mounts the post-ejection head at the downstream side in the recording medium convey direction, or arranges the carriage drive means, so that the carriage, which integrally holds the recording heads, and performs a recording operation while moving in the main scan direction, inclines the post-ejection recording head at a larger angle toward the downstream side in the recording medium convey direction than that of the pre-ejection recording head.

The arrangement of each recording head will be described in detail below. The plurality of recording heads are integrally formed or held to be aligned in a direction parallel or perpendicular to the recording medium convey direction.

BRIEF DESCRIPTION OF THE DRAWINGS

FIG. 3 is a table showing the relationship between the vertical deviation (registration) and the image evaluation results in each embodiment of the present invention;

FIG. 5 is a plan view showing a case wherein the recording heads of the present invention are inclined;

FIGS. 6A and 6B are views showing a vertical deviation set in the present invention;

DESCRIPTION OF THE PREFERRED EMBODIMENTS

The preferred embodiments of a color ink jet recording apparatus according to the present invention will be described in detail hereinafter with reference to the accompanying drawings.

(First Embodiment)

Figure 1:
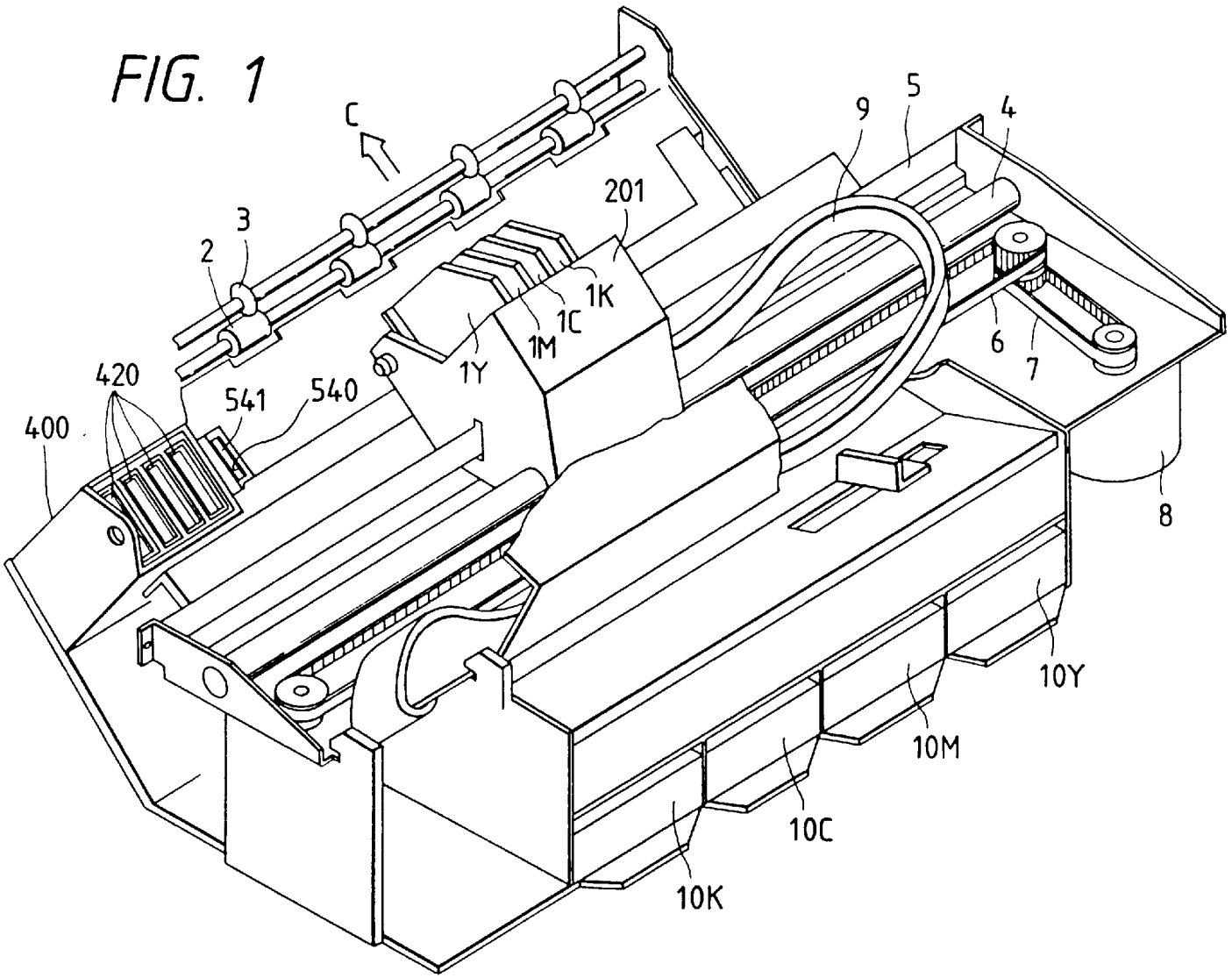
FIG. 1 is a perspective view showing an ink jet printer according to an embodiment of the present invention.

FIG. 1 schematically shows the arrangement of this embodiment. In FIG. 1, each of recording heads 1 is a device, having a plurality of nozzle arrays, for performing image recording on a recording medium by forming dots upon ejection of ink droplets. The different recording heads eject different color inks, and a color image is formed on the recording medium by mixing these ink droplets. The recording heads 1K (black), 1C (cyan), 1M (magenta), and 1Y (yellow) are mounted on a carriage 201, and eject the inks in the order named during one scan period. For example, when a red (to be abbreviated to as R hereinafter) dot is be formed, a magenta (to be abbreviated as M hereinafter) ink lands on the recording medium first, and thereafter, a yellow (to be abbreviated as Y hereinafter) ink lands on the M dot, so that these dots are mixed and are seen as the R dot. Similarly, when a green (to be abbreviated to as G hereinafter) dot is be formed, the inks land in the order of C and Y to form the G dot; and when a blue (to be abbreviated as B hereinafter) dot is to be formed, the inks land in the order of C and M to form the B dot. In this case, since the recording heads 1K, 1C, 1M, and 1Y are arranged at a predetermined pitch (P1), when a solid G pattern is to be recorded, the C dots are recorded, and thereafter, the Y dots are recorded 2×P1 later. More specifically, a solid Y pattern is recorded on a solid C pattern. The carriage 201 receives a driving force from a carriage driving motor 8 through belts 6 and 7, and moves along a sliding shaft. During this operation in the main scan direction, the recording operation in the line (sub-scan) direction is performed. The nozzle pitch of each recording head 1 is 1/360 inch (=70.6 μm), and the resolution is 360 dpi.

Figure 2:
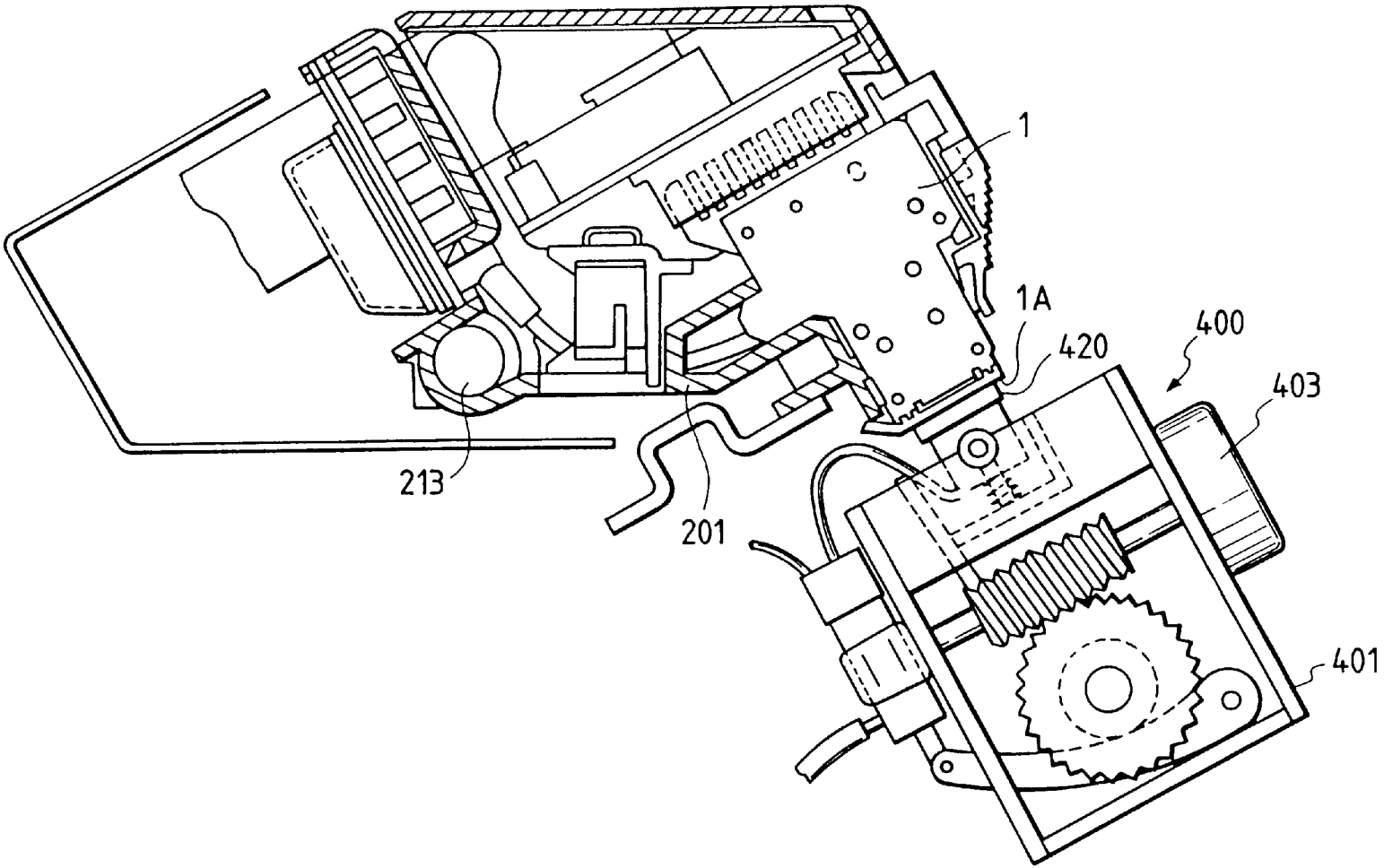
FIG. 2 is a sectional view of the ink jet printer shown in FIG. 1.

A recovery unit 400 has a function of maintaining a good condition of the recording heads. In a non-recording state, caps 420 close the ejection surfaces of the corresponding recording heads to prevent them from, e.g., being dried. For this reason, a position where the carriage 201 faces the recovery unit 400 is called a home position (to be abbreviated to as HP hereinafter). Normally, the recording operation is performed by moving the carriage from the HP. In this embodiment, therefore, the recording operation is performed from left to right in FIG. 1. In a feed operation in the sub-scan direction, the recording medium is fed by a paper feed motor (not shown). A direction of an arrow C in FIG. 1 corresponds to the paper feed direction. FIG. 2 is a longitudinal sectional view showing the positional relationship among the carriage 201, the recording heads 1, and the recording medium. The inks are supplied from ink cassettes 10K, 10C, 10M, and 10Y to the corresponding recording heads 1 on the carriage through supply tubes 9.

Figure 15:
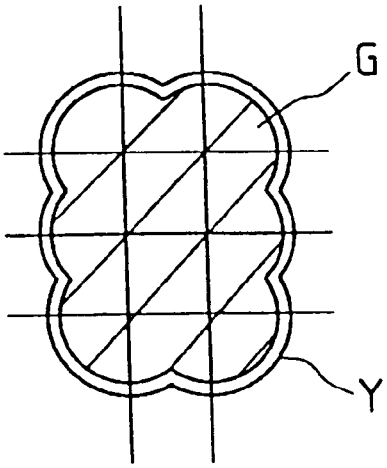
FIG. 15 PRIOR ART
FIG. 15 is a view showing banding.

The present inventors have made extensive studies, and found out that easy generation of the above-mentioned banding was caused by the positional precision of each recording head and, especially, the positional relationship of the recording heads in the vertical direction (FIG. 15). For example, when the inks land in the order of K, C, M, and Y, as the Y recording head is assembled to be deviated toward the upstream side of the paper feed direction as compared to the C recording head, banding becomes conspicuous, and a whitish horizontal stripe pattern appears in a connection section between adjacent recording lines. This point will be described in detail below.

A 1-pass recording mode for performing a recording operation for one line in a single main scan operation with the above arrangement will be described below. When the vertical registration between the two color inks, i.e., a pre-deposited ink and a post-deposited ink, suffers from a deviation, a stripe pattern is formed in a connection section of a mixed color. A case wherein a post-deposited ink is deviated toward the downstream side in the paper feed direction as compared to a pre-deposited ink is represented by "+", and a case wherein a post-deposited ink is deviated toward the upstream side in the paper feed direction as compared to a pre-deposited ink is represented by "−". The deviation is expressed in units of [μm]. FIG. 3 shows the relationship between the deviation of the vertical registration and an image. Note that the nozzle pitch is 360 dpi (=70.6 μm). Image evaluation items include banding and a mixed-color straight line. The item of a mixed-color (two color inks) straight line is evaluated by a limit of separation into two color lines upon deviation of the vertical registration. In this case, a 3-level organoleptic evaluation test was made. The evaluation tests were also classified in units of recording methods, and were made in units of three methods, i.e., a 1-pass recording method, a 2-pass recording method, and a 2-pass ½ line-space recording method.

FIG. 3 illustrates the relationship between vertical deviation of post deposited ink and image evaluation results, where "X," "Δ" and "O" denote "conspicuous," "less conspicuous" and "not conspicuous," respectively, when evaluating banding and straight lines. As shown in FIG. 3, when the deviation of the vertical registration becomes "+", an ink spread amount in a connection section to the next line is decreased, and banding is eliminated. In the case of the 1-pass recording mode, when the post-deposited ink is deviated toward the downstream side by −20 μm or more, the banding is not conspicuous in practice. However, when the vertical registration suffers from too much deviation, since a mixed-color straight line is separated into two (two-color) straight lines, the practical use range is a range A between about −20 μm and about +70 μm in FIG. 3. In this case, it is considered that the upper limit of the range is restricted by the nozzle pitch (70.6 μm). Note that the vertical registration "+" direction indicated by a range A' is more preferable. Note that when four color inks are used, the deviation of the vertical registration between the first deposited ink and the last deposited ink preferably falls within the above-mentioned range.

In this embodiment, at least one of the following countermeasures is taken, so that the deviation of the vertical registration falls within this range. More specifically, the recording width of the recording head or the landing position of the ink is adjusted, so that the post-deposited ink in the connection section is deviated toward the downstream side in the paper feed direction.

(Ejection Amount Setting)

A case will be described below wherein the recording heads having different ejection amount distributions according to the recording order are arranged as a recording width adjustment means for adjusting the recording width. The recording head 1 has a plurality of ink droplet ejection orifices. The recording head can be manufactured, so that all the ejection orifices have different ejection amounts of ink droplets flying therefrom. For example, the recording head is prepared such that the areas of the ejection orifices at the upper and lower end portions of the ejection orifice array are set to be relatively smaller than those of other orifices to obtain a relatively small ejection amount at the two end portions. It was confirmed that when a solid pattern was recorded by the head having a relatively small ejection amount at the two end portions, the recording width could be relatively smaller than that obtained with a standard ejection amount.

Figure 4A:
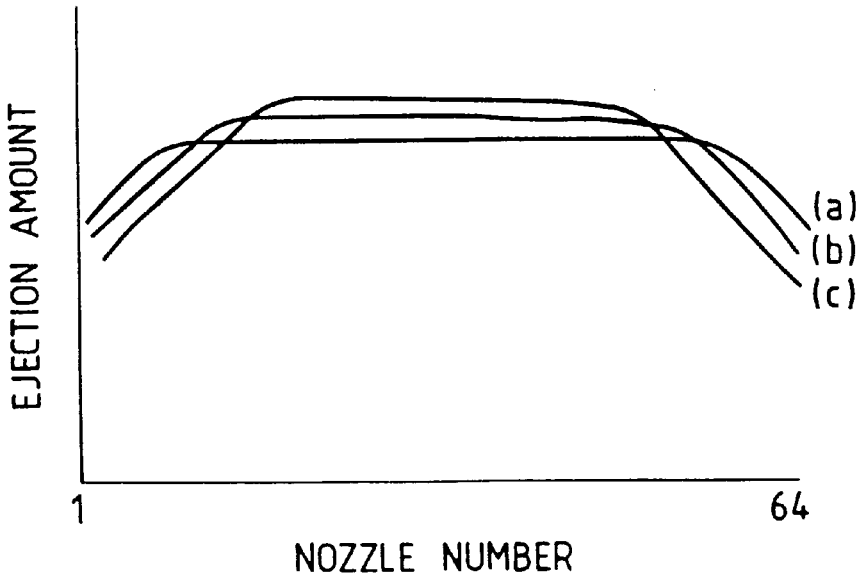
FIGS. 4A and 4B are graphs showing the ejection amount distribution of a recording head of the present invention.

FIG. 4A shows the relationship between the ink ejection amount and the nozzles of the recording head. Although the total ejection amounts using all the nozzles remain almost the same, the recording heads have an ejection amount difference at their two end portions, and have different recording widths, as indicated by curves (a) to (c). By using these characteristics, a recording head having a relatively small ejection amount at the two end portions is arranged at a later position in the recording order. More specifically, as for the relationship between the ejection amounts at the two end portions and the ink colors, K>C>M>Y is set. As has already been described above, this is to decrease the spread amount of the post-deposited ink upon color mixing. When the recording heads were arranged in this order, and a G pattern in which banding was most conspicuous was recorded, almost no banding was observed, and the effect of this embodiment could be demonstrated. It is especially important to decrease the spread amount of the post-deposited ink in the connection section by decreasing the ejection amount at the upstream side in the paper feed direction as the connection section to the next line. Thus, only the ejection amount at this side may be decreased.

Figure 4B:
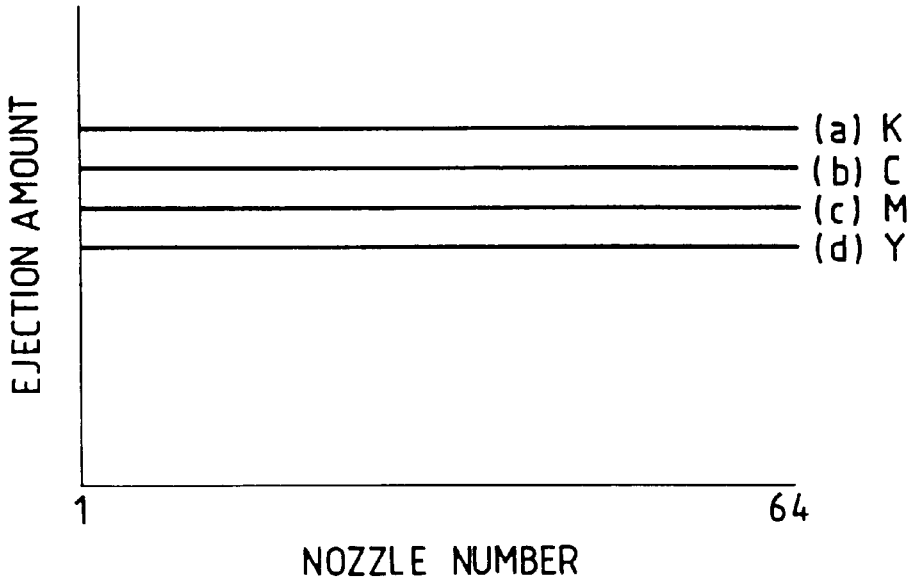

As indicated by lines (a) to (d) in FIG. 4B, the recording heads may have different total ink ejection amounts. Such recording heads can be manufactured by changing the orifice areas of all the ejection orifices as in the above arrangement. In this manner, when the recording heads are arranged to have different total ejection amounts depending on the recording order (K>C>M>Y in this embodiment), the recording width can be sequentially decreased according to the recording order. Thus, since the blur amount of the post-deposited ink in the connection section can be decreased, the banding can be suppressed as in the above arrangement.

(Temperature Control, PWM)

In this embodiment, the ejection amount can be changed by adjusting the driving condition of each recording head. In this embodiment, in the driving operation of the recording head, an ink droplet is ejected using an electrothermal converting element, and the recording head is maintained at a predetermined temperature by a heater for heating the recording head to maintain the predetermined temperature so as to facilitate ejection of the ink. In the recording head of this embodiment, as the heating temperature is higher, the viscosity of the ink is decreased, and the ejection amount itself is increased. For this reason, the heating temperature is changed in correspondence with the recording head to vary the ejection amount in units of ink colors. More specifically, in the conventional apparatus, the temperatures of all the recording heads are set at 36° C. However, in this embodiment, the temperatures of the recording heads are respectively set at, e.g., 44° C. (K), 40° C. (C), 36° C. (M), and 32° C. (Y).

In this manner, when the heating temperatures of the recording heads are sequentially decreased according to the recording order, the ejection amount of the post-deposited ink can be smaller than that of the pre-deposited ink. Since the recording width of the post-deposited ink can be smaller than that of the pre-deposited ink by this head temperature control method like in the above-mentioned case, the spread amount of the post-deposited ink in the connection section can be decreased, and the banding can be suppressed.

It is also known to change the ejection amount by the driving control method of the ink ejection heater. For example, the ejection amount of the post-deposited ink is controlled to be smaller than that of the pre-deposited ink by the ejection amount adjustment method for modulating the number of pre-heat pulses or the pulse width in a double-pulse (multi-pulse) driving method proposed in U.S. Ser. No. 08/104,261 (filed on May 17, 1993, which is a continuation of U.S. Ser. No. 07/821,773 (abandoned)) by the present applicant. Thus, this method can be applied to this embodiment. In the multi-pulse driving method, the number of pre-heat pulses or the pulse width is modulated to control the ink temperature upon application of a main (ink ejection) pulse, thereby adjusting the ink ejection amount.

(Inclination of Head)

A case will be described below wherein the head mounting angle is varied in units of ink colors as another recording width adjustment means. As shown in FIG. 5, in a mechanism for performing recording in the order of 1Y, 1M, 1C, and 1K, the inclination of the head for the post-deposited ink is set to be larger than of the head for the pre-deposited ink so as to decrease the actual recording width. With this structure, the spread amount of the post-deposited ink can be decreased, and banding in a line space portion can be prevented. In order to change the recording width of the adjacent recording heads by 20 μm in the connection section to the next line, since the recording width for 64 nozzles is 4.445 mm, a head inclination angle θ is set to be θ=5.44°. FIG. 5 shows the relationship between the recording order and the inclinations of the heads, and illustrates that pitches of the recording heads may be set to be varied.

In this manner, when the inclinations of the heads are set so that the actual recording width of the post-deposited ink is smaller than that of the pre-deposited ink, banding can be prevented. In this case, when a recording head for ejecting an ink having a low brightness is inclined at a large angle, a conspicuous step pattern may often appear in the connection section of a vertical ruled line. For this reason, only the relationship between the recording widths of the C and Y recording heads for forming a line (G) in which banding is conspicuous may be adjusted, and only the head for the Y ink, which has a high brightness, and does not form a conspicuous step pattern in a ruled line, may be inclined by a predetermined angle.

(Nozzle Pitch)

A case will be explained below wherein the nozzle pitch as a pitch between adjacent ejection orifices is varied in units of recording heads as still another recording width adjustment means. In general, the nozzles of the recording head are aligned in the vertical direction. The nozzle pitch is normally set to be 1/360 inch (=70.6 gm). In this embodiment, in order to set the deviation in the connection section of recording areas by adjacent recording heads to be 20 $\mu$m, the nozzle pitch is decreased by about −0.3 gm in the 64-nozzle recording head.

In this manner, when the nozzle pitch of each color is sequentially decreased according to the recording order, the spread amount of the post-deposited ink in the connection section to the next line can be decreased, and banding can be suppressed. In the recording width adjustment by the nozzle pitch, when it is difficult to adjust all the color heads, as described above, only a specific head may be adjusted.

(Head Mounting)

A landing position control means for controlling the landing position of the post-deposited ink in association with the post-deposited ink blurring suppression method in the connection section according to this embodiment will be described hereinafter. The mounting state of the recording heads will be described below. As shown in FIG. 6A, the recording heads are aligned in line in the main scan direction. At this time, when the vertical positional relationship of the recording heads suffers from a deviation, the above-mentioned spread of the ink occurs.

Thus, in this embodiment, the recording head for the post-deposited ink is arranged to be deviated in advance in a Y direction in FIG. 6A, i.e., toward the downstream side in the paper feed direction. For example, as for the positional relationship between C and Y, the vertical registration of M is set at the upstream side of Y by 20 $\mu$m to obtain a deviation of the vertical registration of 40 $\mu$m, and similarly, the vertical registration of K is set at the upstream side of C by 20 $\mu$m. FIG. 6B shows the vertical registration states of the heads. With this head mounting position adjustment method, since the recording area of the head for the post-deposited ink of a color to be mixed can be sequentially shifted toward the downstream side in the paper feed direction, the spread of the post-deposited ink in the connection section to the next line can be effectively prevented, and banding can be suppressed, as described above.

(CR Backlash)

Figure 7:
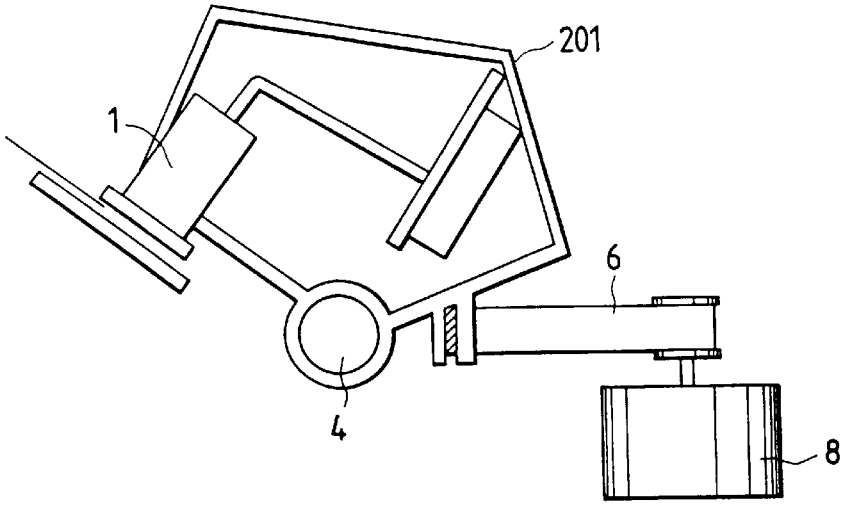
FIG. 7 is a sectional view showing a carriage system.

A case associated with the scan driving method of the carriage for integrally holding a plurality of recording heads as another post-deposited ink landing position adjustment method will be described below. FIG. 7 is a sectional view of the carriage 201 which carries the recording heads, and shows the positional relationship among a sliding shaft 4, the motor 8, and the belt 6, which are used for scan driving the carriage in a recording operation. In the arrangement shown in FIG. 7, when the carriage 201 is driven by the belt 6 to perform a recording operation in the direction of the drawing surface of FIG. 7, it is moved while being inclined in a direction of an arrow a in FIG. 8 with respect to the paper feed direction. For this reason, the recording operation is performed while all the recording heads are inclined at the same angle with respect to the paper feed direction. This is because a bearing portion between the carriage 201 and the sliding shaft 4 has a slight backlash in consideration of contraction of the member. When the recording heads are inclined in this manner, since the lower end portion of the head for the post-deposited ink is located at the upstream side of the lower end portion of the head for the pre-deposited ink in the paper feed direction, the above-mentioned banding tends to be conspicuous.

Figure 8:
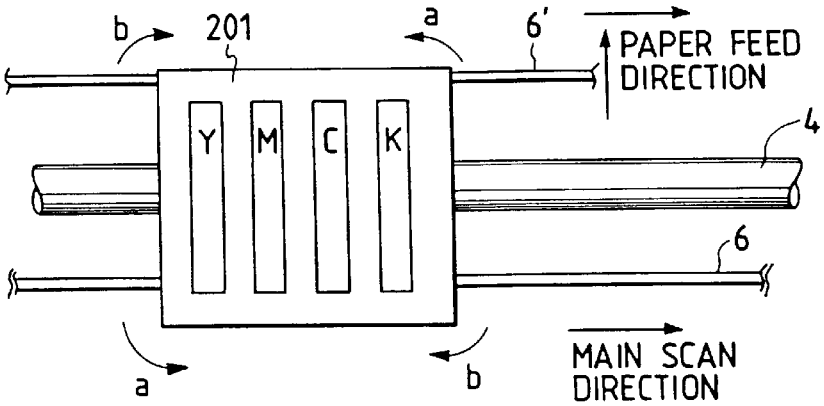
FIG. 8 is a view showing a backlash upon driving of a carriage.
Figure 9:
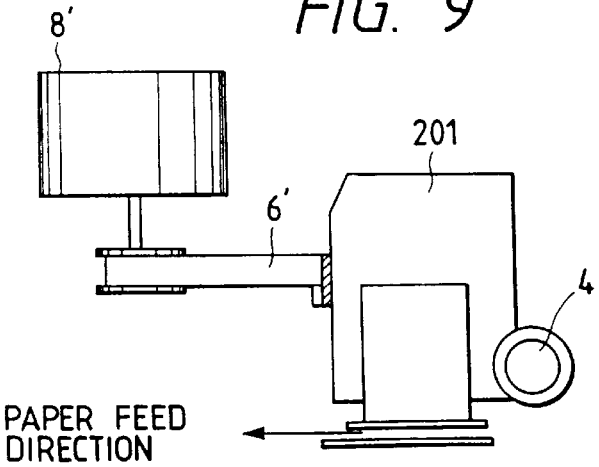
FIG. 9 is a sectional view showing a carriage system of the present invention wherein the vertical deviation of a post-deposited ink is inclined in the recording medium convey direction.

In this embodiment, in association with the relationship among the carriage driving belt, the paper feed direction, and the sliding shaft, a mechanism for shifting the post-deposited ink toward the downstream side in the paper feed direction by utilizing the backlash is provided. FIG. 9 is a sectional view showing the carriage system at this time. In FIG. 9, the recording heads 1 face down, and the recording medium is conveyed from right to left along the X-axis. FIG. 8 is a top view of this state. A belt 6' drives the carriage 201 upon driving of a carriage motor 8', and the carriage 201 is moved in the main scan direction (in the direction of the drawing surface in FIG. 9). At this time, since the carriage 201 is inclined in a direction of an arrow b in FIG. 8, the vertical registration of the post-deposited ink suffers from a deviation toward the downstream side in the paper feed direction contrary to the case shown in FIG. 7, thereby preventing the spread of the post-deposited ink.

(Thinning Multi-pass)

Figure 10:
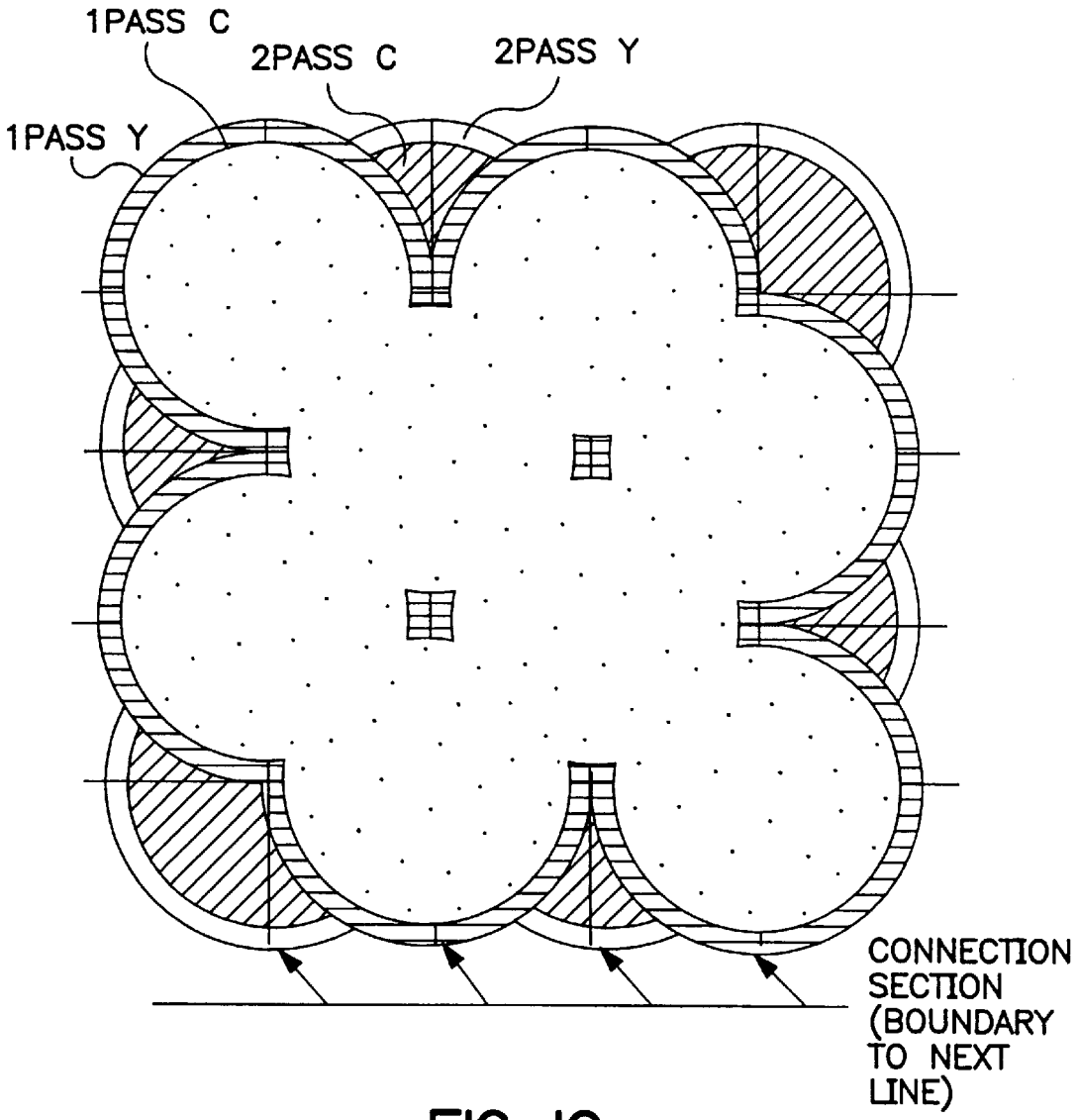
FIG. 10 is a view showing an ink landing state in a 2-pass recording mode.

A thinning multi-pass recording mode will be described below. Since the connection section suppression method of the present invention is effective in the 2-pass recording mode, an application of this embodiment to the 2-pass recording mode will be described below. In this recording method, recording data in one line is divided into two patterns (thinned out), and the two patterns are recorded in two carriage scan operations. FIG. 10 shows the arrangement of dots at that time. Small circles with high and low densities correspond to the first and second pass recording operations of the pre-deposited ink (e.g., C). Large circles outside the small circles correspond to the post-deposited spread ink (e.g., Y).

In the thinning recording mode, in the first pass recording operation, the inks are recorded in the order of C and Y. In this case, the post-deposited Y ink spreads from the C ink. Then, the pre-deposited C ink in the second pass recording operation is recorded on the spread Y ink. Thereafter, since the post-deposited Y ink in the second pass recording operation is recorded, the hue of the C and Y dots recorded in the first pass becomes different from G. The large circles shown in FIG. 10 have two different density differences, which respectively correspond to the first and second passes. As can be seen from FIG. 10, in the thinning recording mode, the ink spread around the dots has different hues in correspondence with passes. For this reason, the connection section between adjacent recording lines becomes very difficult to distinguish as compared to the 1-pass recording mode. Dots recorded in this manner have a hue different from those in the first pass, and are alternately or nonlinearly arranged by thinning. As a result, the banding is suppressed.

In this embodiment, the effect of the 2-pass recording mode can be enhanced. More specifically, in the 2-pass recording mode, since the banding is suppressed by alternately arranging dots whose spread portions have different hues, the effect of this embodiment for decreasing areas having different hues by decreasing the spread amount of dots in the connection section can be enhanced. Referring again to FIG. 3, the banding is not conspicuous when the deviation of the vertical registration is −30 μm or more. In consideration of a range in which a straight line is not separated into two straight lines, the practical use range is a range between −30 μm and +60 μm. In this case, the vertical registration "+" direction, e.g., a range between about +20 μm and +40 μm is more preferable.

(Second Embodiment)

In this embodiment, the banding suppression method based on the post-deposited ink blur amount adjustment method in the connection section according to the present invention is applied to the 2-pass ½ line-space recording method for preventing a feed stripe pattern (caused by a nonuniform feed amount) described in the prior art. In this case, the recording operations are performed in the order of K, C, M, and Y like in the first embodiment.

Figure 11:
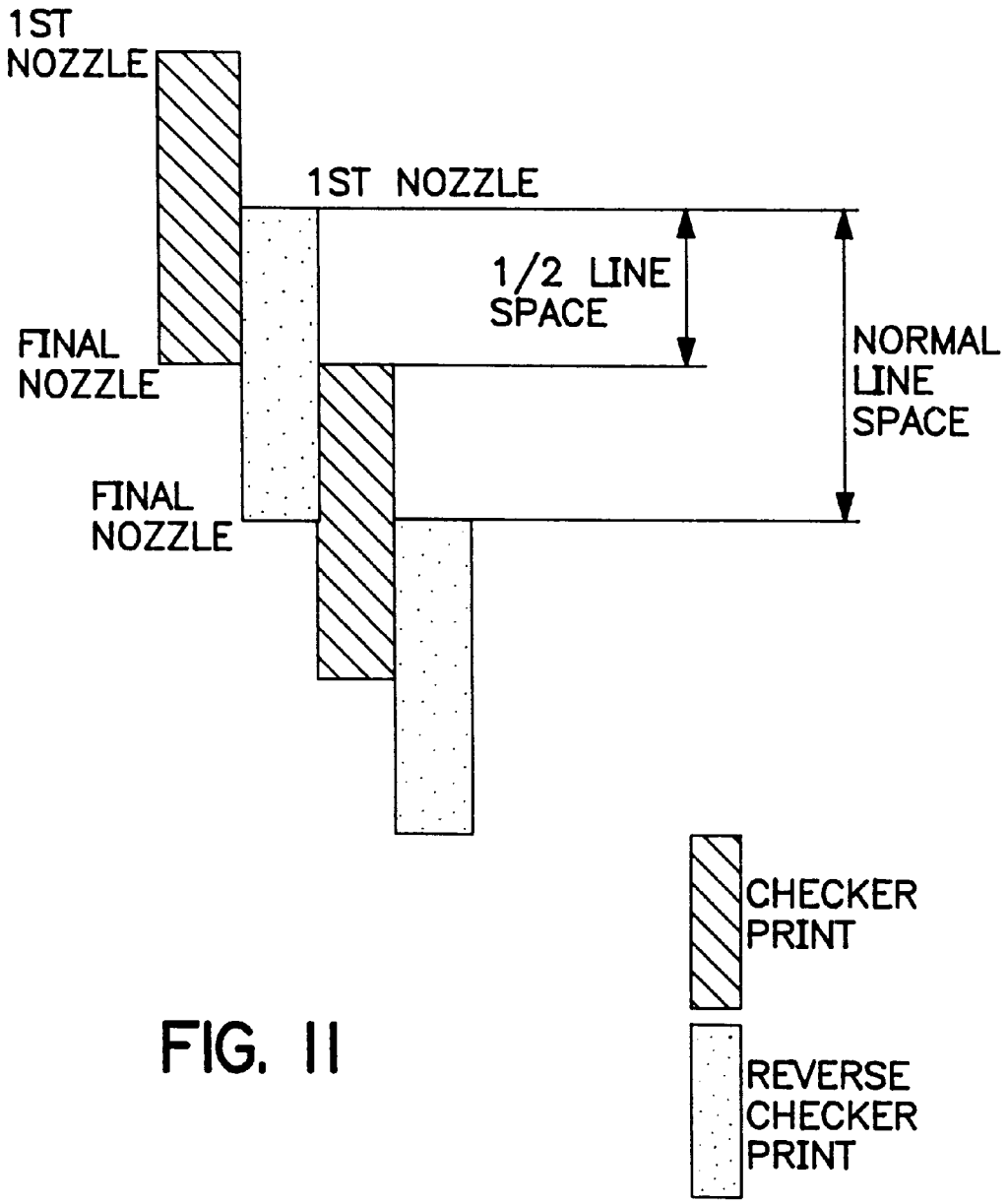
FIG. 11 is a view showing a 2-pass ½ line-space recording mode.

FIG. 11 shows the recording operations and line spaces in this mode. First, dots thinned out in a checker pattern are recorded using the total width of the recording head. Thus, half recording data is recorded. Then, the recording medium is conveyed by a line space width half a normal width. The remaining half recording data is recorded by dots thinned out in a reverse checker pattern, and in a portion overlapping the immediately preceding line, the recording operation of all the data is completed. In the 1- or 2-pass recording mode, the recording operation is performed by periodically repeating ejections from the first to last nozzles (64 nozzles in this embodiment) in turn in each line. Therefore, when a specific nozzle has poor ejection characteristics such as deflection, low landing precision, or the like, this recording error appears at a 64-nozzle period, and periodic stripe patterns are observed. Thus, when the 2-pass ½ line-space mode is used, the line-space width between the recording operations of the checker and reverse checker patterns is shifted by 32 nozzles. For this reason, the periodic ejection deflection is reduced, and a horizontal stripe pattern can be prevented from being formed, thus improving image quality.

This recording mode is very effective for a banding countermeasure. A horizontal stripe pattern formed by the spread of the post-deposited ink is eliminated, and a good image can be obtained by alternately landing the inks in the 2-pass recording mode, and replacing the landing order by the line feed operation of a ½ line space. Referring again to FIG. 3, the banding is not conspicuous when the deviation of the vertical registration is −40 μm or more. In consideration of a range in which a straight line is not separated into two straight lines, the practical use range is a range B between −40 μm and +70 μm shown in FIG. 3. In this case, the vertical registration "+" direction, e.g., a range between about 0 μm and +50 μm is more preferable.

Even when the deviation of the vertical registration is 0 μm, the banding can be satisfactorily prevented, and a good straight line can be recorded. However, since the vertical registration has a tolerance of ±30% caused by, e.g., a head mounting error in practice, it is preferable to set the design reference to be the vertical registration "+" direction, e.g., about +30 μm like in this embodiment since the deviation of the vertical registration is still in the "+" direction even when the vertical registration suffers from a deviation in the "−" direction by 30%.

(Third Embodiment)

In this embodiment, the recording operations are performed in the order of Y, M, C, and K unlike in the above embodiment. When the order of brightness is reversed to that in the above embodiment, banding formed by spread of the post-deposited ink becomes a black stripe pattern according to the above-mentioned description. However, a black stripe pattern is better than a white stripe pattern in terms of an image. In this embodiment, the recording width or the landing position of the post-deposited ink is set at the downstream side in the paper feed direction, thus suppressing the banding.

Figure 12:
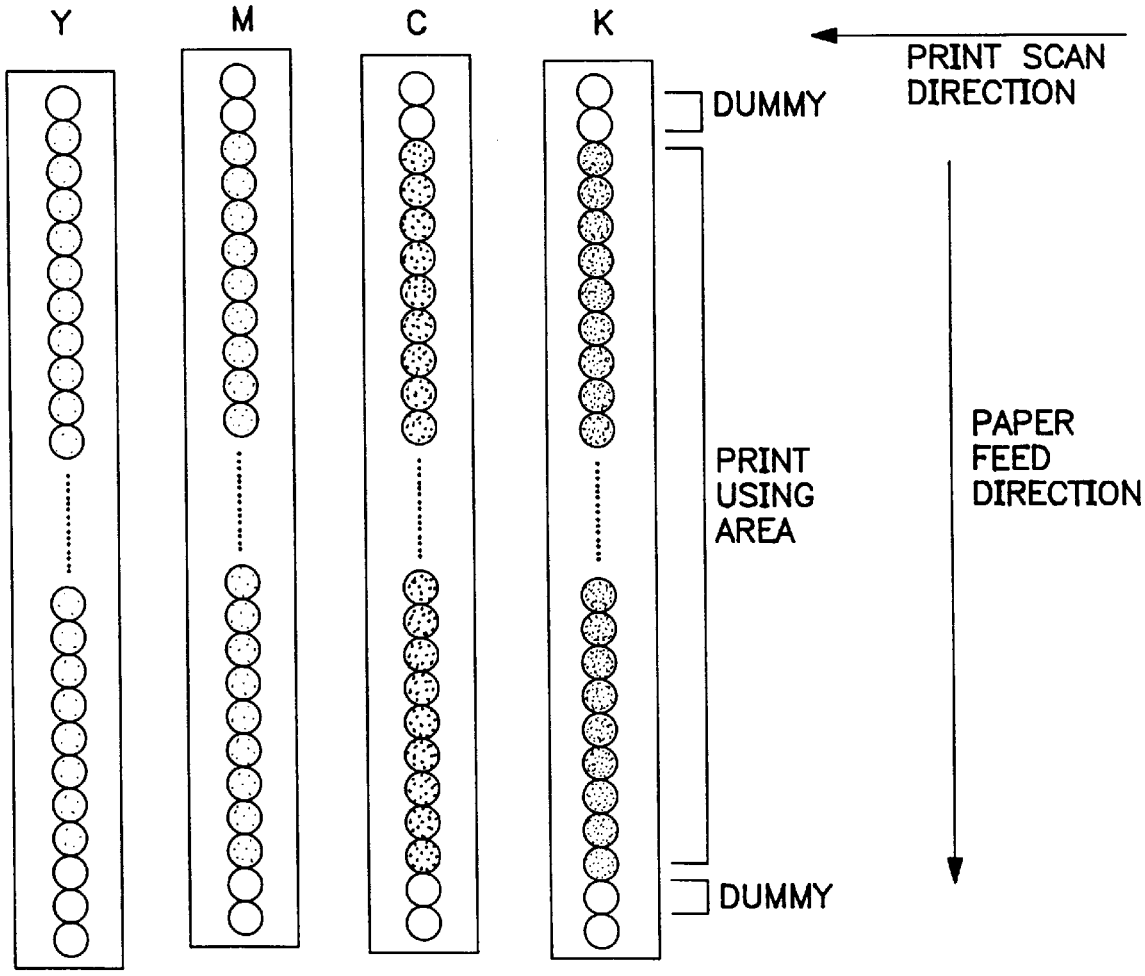
FIG. 12 is a view showing ejection orifice portions of the recording heads of the present invention.

In this embodiment, the means described in the above embodiment can be applied. However, in this embodiment, another means associated with post-deposited ink landing position control will be described below. Note that the recording mode is a 1-pass recording mode. In this embodiment, as shown in FIG. 12, a recording head has more ejection orifices than those used in a normal recording operation, and extra ejection orifices (dummy portions in FIG. 12) are not used in a normal recording operation. In this embodiment, the ink landing position is adjusted using these dummy portions. More specifically, ejection orifices to be used for the post-deposited ink are shifted toward the downstream side in the paper feed direction (or ejection orifices to be used for the pre-deposited ink are shifted toward the upstream side) so as to prevent the ink from spreading in a line space portion. In this manner, even when the recording head suffers from a mounting error on the carriage, the ink landing position in units of recording heads can be easily controlled by electrically selecting nozzles to be used, and the banding can be easily suppressed in each apparatus. The above-mentioned ink landing position control can be applied to each of the above embodiments.

(Fourth Embodiment)

Figure 13:
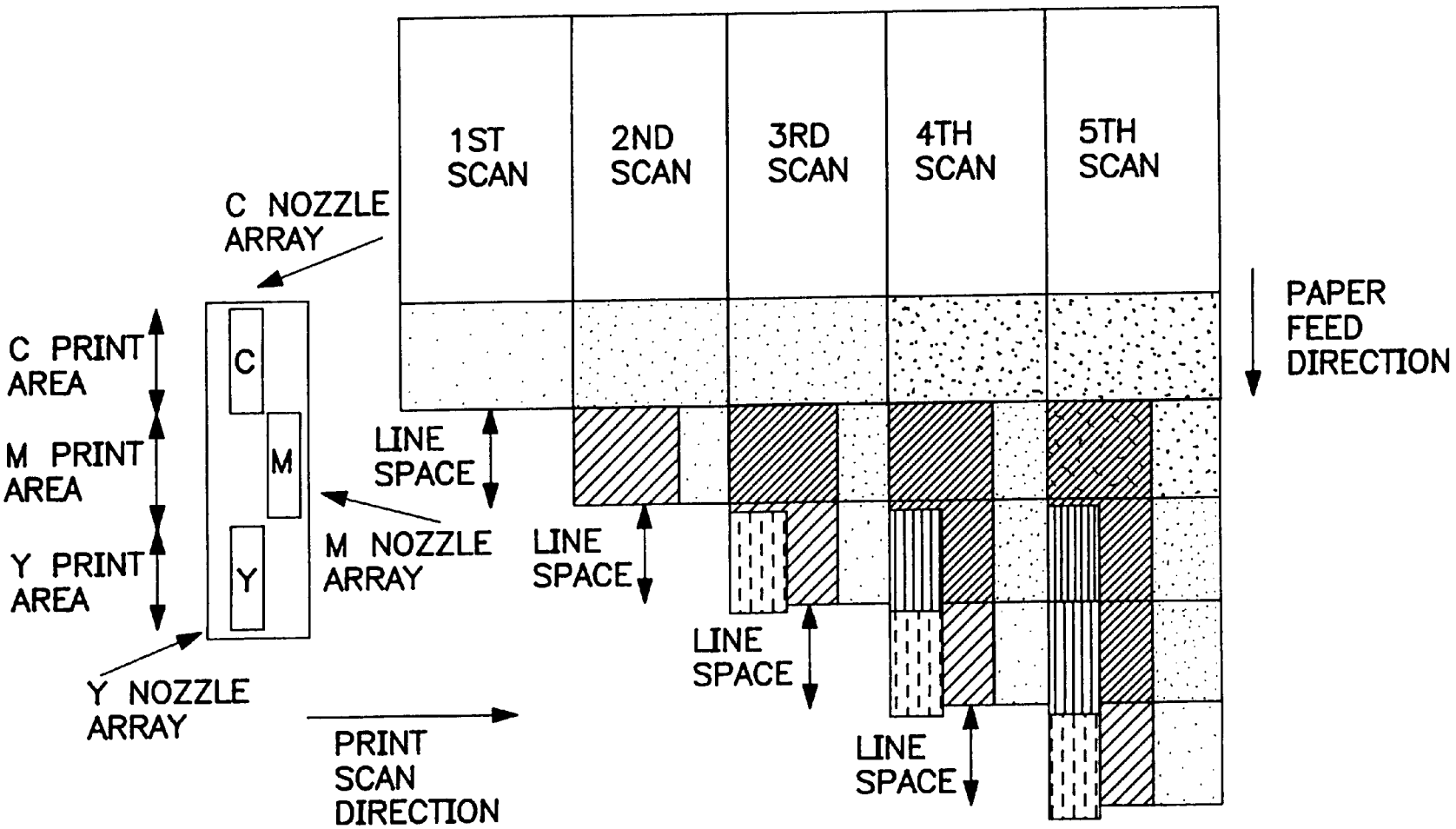
FIG. 13 is a view showing a color-sequential vertically aligned three-color head of the present invention.
Figure 14A:
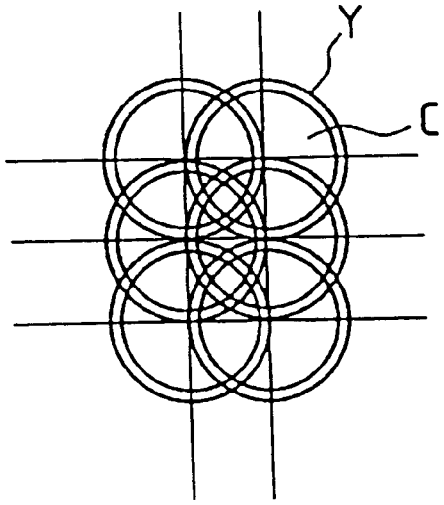
FIG. 14A PRIOR ART
FIGS. 14A and 14B are views showing a mixed-color ink landing state.
Figure 14B:
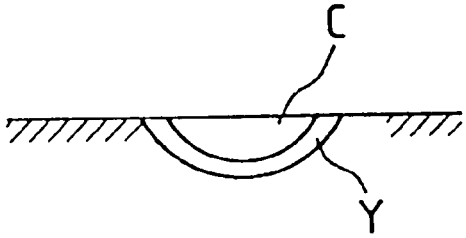
FIG. 14B PRIOR ART

In each of the above embodiments, the recording heads are aligned in a direction parallel to the paper feed direction. However, the present invention is also effective in color recording using a plurality of heads aligned in a direction perpendicular to the paper feed direction. In this embodiment, a head in which ejection orifice arrays for ejecting three color inks are integrally aligned in a direction perpendicular to the paper feed direction will be described below. FIG. 13 shows a recording head prepared by integrally forming nozzle arrays each of which consists of 16 ejection orifices for ejecting three, i.e., C, M, and Y color inks, and are aligned in a direction perpendicular to the paper feed direction (color-sequential vertically aligned three-color head). In the case of this head, since the color nozzle arrays are prepared by forming ejection orifices on a single ejection orifice plate, the landing positions in units of ink colors can be easily set.

In this embodiment, in order to especially improve G and R in which banding is conspicuous, the head is prepared by shifting only the Y nozzle array by a ¼ pixel toward the downstream side in the paper feed direction. In a recording method, the inks land on a recording sheet in the order of C, M, and Y in each scan operation while the recording sheet is sequentially fed by a line space width (line feed width) corresponding to the nozzle array length. In FIG. 13, the landing state of the C ink is indicated by dots by changing the density of dots in units of scan operations, the landing state of the M ink is indicated by hatching, and the landing state of the Y ink is indicated by vertical lines. As can be seen from FIG. 13, since the post-deposited Y ink always lands on the C and M dots in the connection section between adjacent lines while being shifted toward the downstream side in the paper feed direction, the banding in G and R patterns can be suppressed.

In this embodiment, adjustment of the landing positions is facilitated by integrally forming ejection orifices for ejecting a plurality of color inks. However, the present invention is not limited to the vertical alignment, but is effective when the nozzle arrays are integrally formed in a direction parallel to the paper feed direction. Since the ejection amount can be easily changed in units of nozzle arrays, the Y nozzle array may have relatively small ejection orifices to decrease the ejection amount in place of shifting the landing position of the Y nozzle array in this embodiment.

The present invention brings about excellent effects particularly in a recording head and a recording device of the ink jet system using a thermal energy among the ink jet recording systems.

As to its representative construction and principle, for example, one practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal which gives rapid temperature elevation exceeding nucleate boiling corresponding to the recording information on electrothermal converting elements arranged in a range corresponding to the sheet or liquid channels holding liquid (ink), a heat energy is generated by electrothermal converting elements to effect film boiling on the heat acting surface of the recording head, and consequently the bubbles within the liquid (ink) can be formed in correspondence to the driving signals one by one. By discharging the liquid (ink) through a discharge port by growth and shrinkage of the bubble, at least one droplet is formed. By making the driving signals into pulse shapes, growth and shrinkage of the bubble can be effected instantly and adequately to accomplish more preferable discharging of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of a discharging orifice, a liquid channel, and an electrothermal converting element (linear liquid channel or right angle liquid channel) as disclosed in the above specifications, the construction by use of U.S. Pat. Nos. 4,558,333 and 4,459,600 disclosing the construction having the heat acting portion arranged in the flexed region is also included in the invention. The present invention can be also effectively constructed as disclosed in Japanese Laid-Open Patent Application No. 59-123670 which discloses the construction using a slit common to a plurality of electrothermal converting elements as a discharging portion of the electrothermal converting element or Japanese Laid-Open Patent Application No. 59-138461 which discloses the construction having the opening for absorbing a pressure wave of a heat energy corresponding to the discharging portion.

As described above, according to the present invention, since the ink ejected from a post-ejection recording head of the plurality of recording heads is infiltrated and fixed while being shifted toward the downstream side in the recording medium convey direction as compared to the ink ejected from a pre-ejection recording head, banding appearing in a line space portion can be prevented.

What is claimed is:

1. A color ink jet recording apparatus comprising:

a recording device including a plurality of recording portions for respectively ejecting different color inks, each of said recording portions having a plurality of ejection orifices aligned at a predetermined pitch to record dots separated by a predetermined dot pitch;

scanning means for scanning said plurality of recording portions relative to a recording medium in a scanning direction, said recording portions forming a swath having at least one predetermined mixed color area on the recording medium by ejecting the different color inks from said plurality of ejecting orifices during a recording scan of said plurality of recording portions by said scanning means;

conveying means for conveying the recording medium in a convey direction so as to sequentially form a color image on the recording medium by mixing the color inks, the convey direction being different from the scanning direction; and shift control means for controlling said plurality of recording portions, said scanning means and said conveying means such that (i) the ink ejected from a post-ejection recording portion of said plurality of recording portions is infiltrated in and fixed on the recording medium while being shifted by a predetermined amount less than the predetermined dot pitch toward a downstream side in the convey direction of the recording medium as compared to the ink ejected from a pre-ejection recording portion, and (ii) wherein the ink from the post-ejection recording portion and the ink from the pre-ejection recording portion are ejected to the same swath, the ink ejected from the post-ejection recording portion being added to the ink ejected from the pre-ejection recording portion onto the recording medium, and the ink ejected from the pre-ejection recording portion and the ink ejected from the post-ejection recording portion being different in color from each other.

2. An apparatus according to claim 1, wherein a recording width of the post-ejection recording portion is set to be smaller than a recording width of the pre-ejection recording portion, thereby shifting the ink.

3. An apparatus according to claim 2, wherein mounting angles of said plurality of recording portions with respect to the convey direction of said recording medium are set to be variable, so that an inclination angle of the post-ejection recording portions is set to be larger than an inclination angle of the pre-ejection recording portion, thereby decreasing the recording width.

4. An apparatus according to claim 1, wherein ink landing positions on said recording medium in units of said plurality of recording portions are adjusted, so that an ink landing position of the post-ejection recording portion is set at a downstream side in the convey direction of said recording medium as compared to an ink landing position of the pre-ejection recording portion, thereby shifting the ink.

5. An apparatus according to claim 4, wherein mounting positions of said plurality of recording portions are set to be variable in the convey direction of said recording medium, so that the post-ejection recording portion is mounted at the downstream side in the convey direction of said recording medium as compared to an mounting position of the pre-ejection recording portion, thereby adjusting the ink landing position.

6. An apparatus according to claim 4, further comprising carriage drive means for driving a carriage holding the plurality of recording portions and arranged to move in the scan direction, and inclines the post-ejection recording portion at a larger angle toward the downstream side in the convey direction of said recording medium than the pre-ejection recording portion, thereby adjusting the ink landing position.

7. An apparatus according to claim 1, wherein said plurality of recording portions are integrally formed or held to be aligned in a direction perpendicular to the convey direction of said recording medium.

8. An apparatus according to claim 1, wherein each of said plurality of recording causes a change in state in the ink by portion energy, and ejects the ink on the basis of the change in state.

9. A color ink jet recording apparatus comprising:

a recording device including a plurality of recording portions for respectively ejecting different color inks, each of said portions having a plurality of ejection orifices aligned at a predetermined pitch and said plurality of recording portions are integrally formed or held to be aligned in a direction substantially parallel to a convey direction of a recording medium;

scanning means for scanning said plurality of recording portions relative to a recording medium in a scanning direction, said recording portions forming a swath of a mixed color on the recording medium by ejecting the different color inks from said plurality of ejecting orifices in accordance with a scan of a plurality of recording portions by said-scanning means;

conveying means for conveying the recording medium in the convey direction so as to sequentially form a color image on the recording medium by mixing the color inks, the convey direction being different from the scanning direction; and shift control means for controlling said plurality of recording portions, said scanning means and said conveying means such that (i) the ink ejected from a post-ejection recording portion of said plurality of recording portions is infiltrated in and fixed on the recording medium while being shifted by a predetermined amount less than the predetermined pitch toward a downstream side in the convey direction of the recording medium as compared to the ink ejected from a pre-ejection recording portion, and (ii) wherein the ink from the post-ejection recording portion and the ink from the preejection recording portion are ejected to the same swath, the ink ejected from the post-ejection recording portion being added to the ink ejected from the pre-ejection recording portion onto the recording medium, and the ink ejected from the pre-ejection recording portion and the ink ejected from the post-ejection recording portion being different in color from each other.

10. A color ink jet recording method for forming an image on a recording medium by scanning a plurality of recording portions, each recording portion having a plurality of ejection orifices aligned at a predetermined pitch to record dots separated by a predetermined dot pitch, for ejecting different color inks from said plurality of ejection orifices during the scanning of the plurality of recording portions, said method comprising the steps of:

forming a first swath by ejecting a first color ink from a recording portion onto said recording medium during a scan of said recording portions in a scanning direction; and forming a second swath by ejecting a second color ink from another recording portion onto the first swath previously formed on said recording medium during the scan of said recording portions so as to form a swath having at least one predetermined mixed color area, the second swath being shifted from the first swath by a predetermined amount less than the predetermined dot pitch toward a downstream side in a convey direction of said recording medium different from the scanning direction, the ink ejected in said second swath forming step being added to the ink ejected in said first swath forming step, and the ink ejected in said first swath forming step and the ink ejected in said second swath forming step being different in color from each other.

11. A method according to claim 10, wherein a recording width of the recording portion for forming the second swath is set to be smaller than a recording width of the recording portion for forming the first swath, thereby shifting the second swath.

12. A method according to claim 11, wherein mounting angles of said plurality of recording portions with respect to the convey direction of said recording medium are set to be variable, so that an inclination angle of the recording portion for forming the second swath is set to be larger than an inclination angle of the recording portion for forming the first swath, thereby decreasing the recording width.

13. A method according to claim 10, wherein ink landing positions on said recording medium in units of said plurality of recording portions are adjusted, so that an ink landing position of the recording portion for forming the second swath is set at a downstream side in the convey direction of said recording medium as compared to an ink landing position of the recording portion for forming the first swath, thereby shifting the second swath.

14. A method according to claim 13, wherein mounting positions of said plurality of recording portions are set to be variable in the convey direction of said recording medium, so that the recording portion for forming the second swath is mounted at the downstream side in the convey direction of said recording medium as compared to a mounting position of the recording portion for forming the first swath, thereby adjusting the ink landing position.

15. A method according to claimed 13, wherein carriage drive means is arranged, so that a carriage, which integrally holds said plurality of recording portions, and moves in the scan direction, during movement in the scan direction, inclines the recording portion for forming the second swath at a larger angle toward the downstream side in the convey direction of said recording medium than the recording portion for forming the first swath, thereby adjusting the ink landing position.

16. A method according to claim 10, wherein said plurality of recording portions are integrally formed or held to be aligned in a direction perpendicular to the convey direction of said recording medium.

17. A method according to claim 10, wherein each of said plurality of recording portions causes a change in state in the ink by heat energy, and ejects the ink on the basis of the change in state.

18. A color ink jet recording method for forming an image on a recording medium by scanning a plurality of recording portions, each recording portion having a plurality of ejection orifices aligned at a predetermined pitch, for ejecting different color inks from said plurality of ejection orifices during the scanning of the plurality of recording portions, said method comprising the steps of:

forming a first swath by ejecting a first color ink from a recording portion onto said recording medium during a scan of said recording portions in a scanning direction; and forming a second swath by ejecting a second color ink from another recording portion onto the first swath previously formed on said recording medium during the scan of said recording portions so as to form a swath of a mixed color, the second swath being shifted from the first swath by less than the predetermined pitch toward a downstream side in a convey direction of said recording medium different from the scanning direction, the ink ejected in said second swath forming step being added to the ink ejected in said first swath forming step, the ink ejected in said first swath forming step and the ink ejected in said second swath forming step being different in color from each other, and said plurality of recording portion are integrally formed or held to be aligned in a direction substantially parallel to the convey direction of said recording medium.

19. A method for preventing a striped pattern from being formed at a connecting section between adjacent mixed color swaths in a color ink jet recording process, the color ink jet recording process being for forming an image on a recording medium by scanning a plurality of recording portions, each recording portion having a plurality of ejection orifices aligned at a predetermined pitch to record dots separated by a predetermined dot pitch, for ejecting different color inks from said plurality of ejection orifices during scanning of the plurality of recording portions, said method comprising the steps of:

forming a first swath by ejecting a first color ink from a recording portion onto said recording medium during a scan of said recording portions in a scanning direction; and forming a second swath by ejecting a second color ink from another recording portion onto the first swath previously formed on said recording medium during the scan of said recording portions so as to form a swath having at least one predetermined mixed color area, the second swath being shifted from the first swath by a predetermined amount less than the predetermined dot pitch toward a downstream side in a convey direction of said recording medium different from the scanning direction, the ink ejected in said second swath forming step being added to the ink ejected in said first swath forming step, and the ink ejected in said first swath forming step and the ink ejected in said second swath forming step being different in color from each other.

20. A color ink jet recording apparatus comprising:

a recording device including a plurality of recording portions for respectively ejecting different color inks, each of said portions having a plurality of ejection orifices aligned at a predetermined pitch, wherein a recording width of a post-ejection recording portion is set to be smaller than a recording width of a pre-ejection recording portion, thereby shifting the ink;

scanning means for scanning said plurality of recording portions relative to a recording medium, said recording portions forming a swath of a mixed color on the recording medium by ejecting the different color inks from said plurality of ejecting orifices in accordance with a scan of said plurality of recording portions by said scanning means;

conveying means for conveying the recording medium so as to sequentially form a color image on the recording medium by mixing the color inks; and shift control means for controlling said plurality of recording portions, said scanning means and said conveying means such that (i) the ink ejected from the post-ejection recording portion of said plurality of recording portions is infiltrated in and fixed on the recording medium while being shifted by a predetermined amount less than the predetermined pitch toward a downstream side in the convey direction of the recording medium as compared to the ink ejected from the pre-ejection recording portion, and (ii) wherein the ink from the post-ejection recording portion and the ink from the pre-ejection recording portion are ejected to the same swath, the ink ejected from the post-ejection recording portion being added to the ink ejected from the pre-ejection recording portion onto the recording medium, and the ink ejected from the pre-ejection recording portion and the ink ejected from the post-ejection recording portion being different in color from each other, wherein average ejection amounts in units of said plurality of recording portions are pre-set to be variable with respect to each other, so that an ejection amount of the post-ejection recording portion is set to be smaller than an ejection amount of the pre-ejection recording portion, thereby decreasing the recording width.

21. An apparatus according to claim 20, wherein each of said plurality of recording portions causes a change in state in the ink by heat energy, and ejects the ink on the basis of the change in state.

22. A color ink jet recording apparatus comprising:

a recording device including a plurality of recording portions for respectively ejecting different color inks, each of said portions having a plurality of ejection orifices aligned at a predetermined pitch, wherein a recording width of a post-ejection recording portion is set to be smaller than a recording width of a pre-ejection recording portion, thereby shifting the ink;

scanning means for scanning said plurality of recording portions relative to a recording medium, said recording portions forming a swath of a mixed color on the recording medium by ejecting the different color inks from said plurality of ejecting orifices in accordance with a scan of said plurality of recording portions by said scanning means;

conveying means for conveying the recording medium so as to sequentially form a color image on the recording medium by mixing the color inks; and shift control means for controlling said plurality of recording portions, said scanning means and said conveying means such that (i) the ink ejected from the post-ejection recording portion of said plurality of recording portions is infiltrated in and fixed on the recording medium while being shifted by a predetermined amount less than the predetermined pitch toward a downstream side in the convey direction of the recording medium as compared to the ink ejected from the pre-ejection recording portion, and (ii) wherein the ink from the post-ejection recording portion and the ink from the pre-ejection recording portion are ejected to the same swath, the ink ejected from the post-ejection recording portion being added to the ink ejected from the pre-ejection recording portion onto the recording medium, and the ink ejected from the pre-ejection recording portion and the ink ejected from the post-ejection recording portion being different in color from each other, wherein ejection amount distributions in units of said plurality of recording portions are pre-set to be variable with respect to each other, so that an ejection amount at upstream-side end portions, in the convey direction of said recording medium, of the post-ejection recording portion is set to be smaller than an ejection amount of the pre-ejection recording portion, thereby decreasing the recording width.

23. An apparatus according to claim 22, wherein each of said plurality of recording portions causes a change in state in the ink by heat energy, and ejects the ink on the basis of the change in state.

24. A color ink jet recording apparatus comprising:

a recording apparatus including a plurality of recording portions for respectively ejecting different color inks, each of said portions having a plurality of ejection orifices aligned at a predetermined pitch, wherein a recording width of a post-ejection recording portion is set to be smaller than a recording width of a pre-ejection recording portion, thereby shifting the ink, and wherein predetermined pitches of said plurality of recording portions are varied with respect to each other so that a predetermined pitch of the post-ejection recording portion is pre-set to be smaller than a predetermined pitch of the pre-ejection recording portion, thereby decreasing the recording width;

scanning means for scanning said plurality of recording portions relative to a recording medium, said recording portions forming a swath of a mixed color on the recording medium by ejecting the different color inks from said plurality of ejecting orifices in accordance with a scan of said plurality of recording portions by said scanning means;

conveying means for conveying the recording medium so as to sequentially form a color image on the recording medium by mixing the color inks; and shift control means for controlling said plurality of recording portions, said scanning means and said conveying means such that (i) the ink ejected from the post-ejection recording portion of said plurality of recording portions is infiltrated in and fixed on the recording medium while being shifted by a predetermined amount less than the predetermined pitch toward a downstream side in the convey direction of the recording medium as compared to the ink ejected from the pre-ejection recording portion, and (ii) wherein the ink from the post-ejection recording portion and the ink from the pre-ejection recording portion are ejected to the same swath, the ink ejected from the post-ejection recording portion being added to the ink ejected from the pre-ejection recording portion onto the recording medium, and the ink ejected from the pre-ejection recording portion and the ink ejected from the post-ejection recording portion being different in color from each other.

25. An apparatus according to claim 24, wherein each of said plurality of recording portions causes a change in state in the ink by heat energy, and ejects the ink on the basis of the change in state.

26. A color ink jet recording method for forming an image on a recording medium by scanning a plurality of recording portions, each recording portion having a plurality of ejection orifices aligned at a predetermined pitch, for ejecting different color inks from said plurality of ejection orifices during scanning of the plurality of recording portions, said method comprising the steps of:

forming a first swath by ejecting a first color ink from a recording portion onto said recording medium during a scan of said recording portions; and forming a second swath by ejecting a second color ink from another recording portion onto the first swath previously formed on said recording medium during the scan of said recording portions so as to form a swath of a mixed color, the second swath being shifted from the first swath by a predetermined amount less than the predetermined pitch toward a downstream side in a convey direction of said recording medium, the ink ejected in said second swath forming step being added to the ink ejected in said first swath forming step, and the ink ejected in said first swath forming step and the ink ejected in said second swath forming step being different in color from each other, wherein a recording width of a recording portion for forming the second swath is set to be smaller than a recording width of a recording portion for forming the first swath, thereby shifting the second swath, and wherein average ejection amounts in units of said plurality of recording portions are pre-set to be variable with respect to each other, so that an ejection amount of the recording portion for forming the second swath is set to be smaller than an ejection amount of the recording portion for forming the first swath, thereby decreasing the recording width.

27. A method according to claim 26, wherein each of said plurality of recording portions causes a change in state in the ink by heat energy, and ejects the ink on the basis of the change in state.

28. A color ink jet recording method for forming an image on a recording medium by scanning a plurality of recording portions, each recording portion having a plurality of ejection orifices aligned at a predetermined pitch, for ejecting different color inks from said plurality of ejection orifices during scanning of the plurality of recording portions, said method comprising the steps of:

forming a first swath by ejecting a first color ink from a recording portion onto said recording medium during a scan of said recording portions; and forming a second swath by ejecting a second color ink from another recording portion onto the first swath previously formed on said recording medium during the scan of said recording portions so as to form a swath of a mixed color, the second swath being shifted from the first swath by a predetermined amount less than the predetermined pitch toward a downstream side in a convey direction of said recording medium, the ink ejected in said second swath forming step being added to the ink ejected in said first swath forming step, and the ink ejected in said first swath forming step and the ink ejected in said second swath forming step being different in color from each other, wherein a recording width of a recording portion for forming the second swath is set to be smaller than a recording width of a recording portion for forming the first swath, thereby shifting the second swath, and wherein ejection amount distributions in units of said plurality of recording portions are pre-set to be variable with respect to each other, so that an ejection amount, at upstream-side end portions in the convey direction, of said recording medium of the recording portion for forming the second swath is set to be smaller than an ejection amount of the recording portion for forming the first swath, thereby decreasing the recording width.

29. A method according to claim 28, wherein each of said plurality of recording portions causes a change in state in the ink by heat energy, and ejects the ink on the basis of the change in state.

30. A color ink jet recording method for forming an image on a recording medium by scanning a plurality of recording portions, each recording portion having a plurality of ejection orifices aligned at a predetermined pitch, for ejecting different color inks from said plurality of ejection orifices during scanning of the plurality of recording portions, said method comprising the steps of:

forming a first swath by ejecting a first color ink from a recording portion onto said recording medium during a scan of said recording portions; and forming a second swath by ejecting a second color ink from another recording portion onto the first swath previously formed on said recording medium during the scan of said recording portions so as to form a swath of a mixed color, the second swath being shifted from the first swath by a predetermined amount less than the predetermined pitch toward a downstream side in a convey direction of said recording medium, the ink ejected in said second swath forming step being added to the ink ejected in said first swath forming step, and the ink ejected in said first swath forming step and the ink ejected in said second swath forming step being different in color from each other, wherein a recording width of a recording portion for forming the second swath is set to be smaller than a recording width of a recording portion for forming the first swath, thereby shifting the second swath, and wherein respective pitches of said plurality of recording portions are pre-set to be variable with respect to each other, so that a pitch of the recording portion for forming the second swath is set to be smaller than a pitch of the recording portion for forming the first swath, thereby decreasing the recording width.

31. A method according to claim 30, wherein each of said plurality of recording portions causes a change in state in the ink by heat energy, and ejects the ink on the basis of the change in state.

* * * * *

UNITED STATES PATENT AND TRADEMARK OFFICE

CERTIFICATE OF CORRECTION

PATENT NO. : 6,068,365
DATED : May 30, 2000
INVENTOR(S) : Shigeyasu Nagoshi et al.

It is certified that error appears in the above-identified patent and that said Letters Patent is hereby corrected as shown below:

Title page,
Item [56], References Cited,
U.S. PATENT DOCUMENTS, insert: -- 4,540,996 9/1985 Saito -- and -- 4,814,886 3/1989 Kuge et al. --

FOREIGN PATENT DOCUMENTS, insert: "1063185" should read -- 1-063185 -- and "1208143" should read -- 1-208143 -- and "2233260" should read -- 2-233260 --.

Column 2,
Line 49, "Alternatively," should read -- Alternatively, --.

Column 3,
Line 54, "to as" should read -- as --; and
Line 59, "to as" should read -- as --.

Column 4,
Line 14, "to as" should read -- as --; and
Line 66, "As" should read -- As --.

Column 5,
Line 9, "A" should read -- A --.

Column 7,
Line 32, "(Ilead" should read -- (Head --; and
Line 38, "As" should read -- As -- and "6A," should read -- 6A, --.

Column 10,
Line 40, "below. FIG." should read -- below. ¶ FIG. --.

Column 11,
Line 47, "be also" should read -- also be --.

Column 12,
Line 42, "portions" should read -- portion --.

Column 13,
Line 6, "recording" should read -- recording portions --;
Line 7, "portion" should read -- heat --; and
Line 40, "preejection" should read -- pre-ejection --.

UNITED STATES PATENT AND TRADEMARK OFFICE

CERTIFICATE OF CORRECTION

PATENT NO. : 6,068,365
DATED : May 30, 2000
INVENTOR(S) : Shigeyasu Nagoshi et al.

It is certified that error appears in the above-identified patent and that said Letters Patent is hereby corrected as shown below:

Column 14,
Line 48, "Λ" should read -- A --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*